United States Patent [19]

Fujii et al.

[11] Patent Number: 4,682,880

[45] Date of Patent: Jul. 28, 1987

[54] MULTICOLOR IMAGE RECORDING METHOD AND DEVICE UTILIZING A SINGLE IMAGE TRANSFER TO THE RECORDING MATERIAL

[75] Inventors: Haruo Fujii, Yokohama; Yutaka Inaba, Kawaguchi; Yujiro Ando, Yokohama, all of Japan

[73] Assignee: Canon Kabushiki Kaisha, Tokyo, Japan

[21] Appl. No.: 774,490

[22] Filed: Sep. 10, 1985

[30] Foreign Application Priority Data

Sep. 13, 1984 [JP] Japan ..... 59-190537

[51] Int. Cl.[4] ..... G03G 15/01

[52] U.S. Cl. ..... 355/4; 355/77; 430/44

[58] Field of Search ..... 355/4, 3 R, 15, 3 TR, 355/77; 430/42, 44, 126, 48

[56] References Cited

U.S. PATENT DOCUMENTS 3,697,171 10/1972 Sullivan ..... 430/126

3,838,919 10/1974 Takahashi ..... 355/4

4,006,983 2/1977 Pressman et al. ..... 355/4

*Primary Examiner*—R. L. Moses

*Attorney, Agent, or Firm*—Fitzpatrick, Cella, Harper & Scinto

[57] ABSTRACT

An electrostatic latent image is formed on a rotatable latent image bearing member and is developed with a developer into a visualized image on the latent image bearing member. The visualized image is transferred by pressure to a rotatable visualized image bearing member. Those steps are repeated with different color developers to form on the same visualized image bearing member a multi-color image which corresponds to one final image to be recorded. The latent image bearing member and the visualized image bearing member are cooperative to form a nip therebetween, through which a recording material is passed so that the multi-color image is transferred all at once to a recording material. The multi-color image may be a full-color or pictorial image or a combination of monochromatic images of different colors.

9 Claims, 1 Drawing Figure

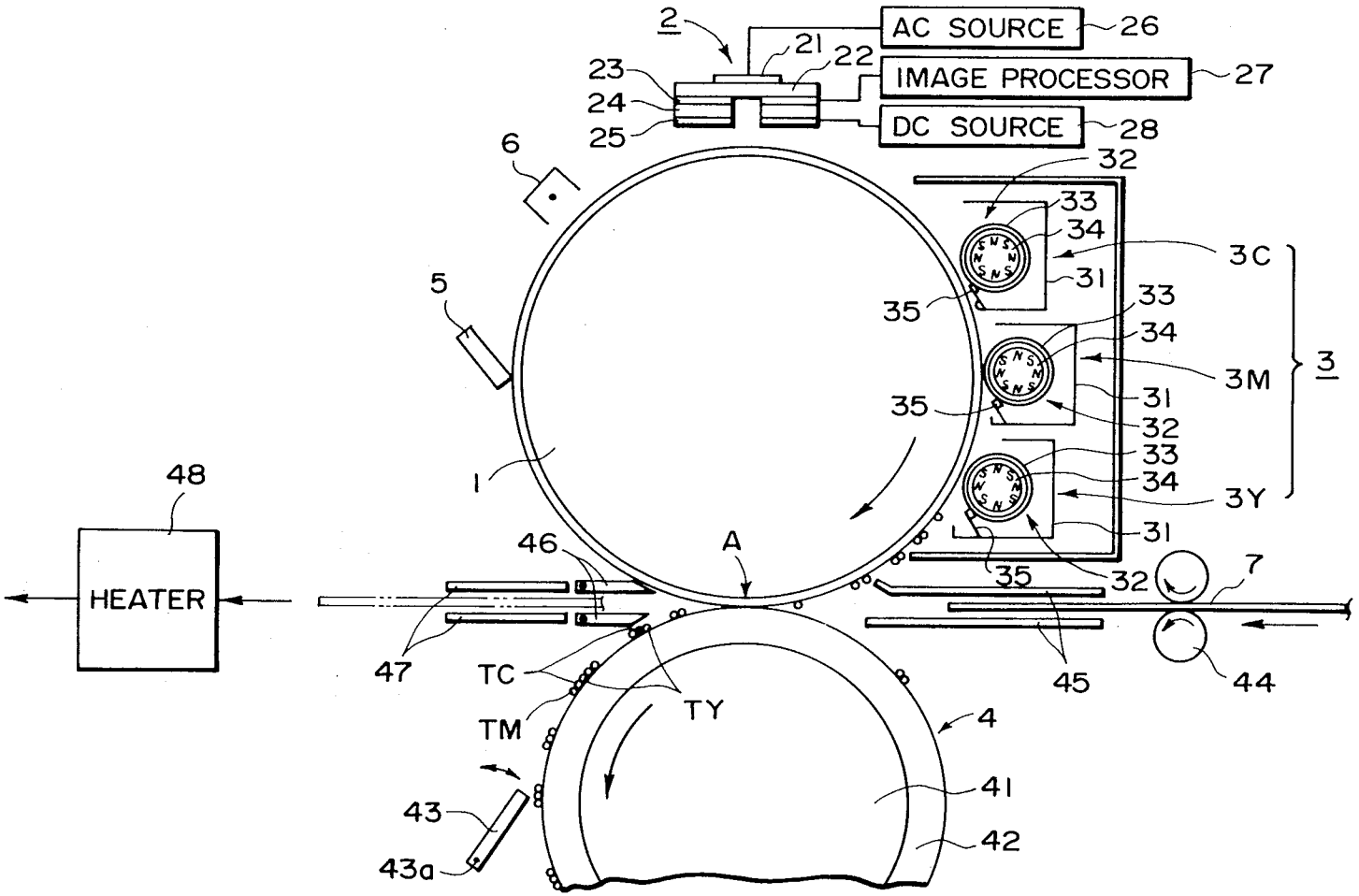
AC SOURCE
IMAGE PROCESSOR
DC SOURCE
HEATER
3
3C
3M
3Y
TY
TC
TM
A

MULTICOLOR IMAGE RECORDING METHOD AND DEVICE UTILIZING A SINGLE IMAGE TRANSFER TO THE RECORDING MATERIAL

FIELD OF THE INVENTION AND RELATED ART

The present invention relates to image recording method and apparatus such as electrostatic recording method and apparatus or electrophotographic process and apparatus, more particularly to an image recording method and apparatus for recording a color image.

As for an image recording apparatus for recording a color image, it is known that an image to be recorded is separated into several color-separated images; image recording signals are produced with respect to one of the color-separated images; an electrostatic latent image is formed on a recording medium such as a dielectric member or a photosensitive member in accordance with the image recording signal; the electrostatic latent image is developed by coloring powder (hereinafter called "toner") having the color corresponding to the color of the color-separated image; the developed image is transferred onto a recording member; the above-described series of steps is repeated on one and the same recording paper or the like with respect to the respective color components; and one final image is provided on the recording member.

In the image recording apparatus of this type, some mechanism is required in order to feed a pluralty of times the recording paper to the recording medium. As for such a feeding mechanism, a rotatable drum is usually employed which is opposed to the recording medium and is capable of carrying the recording member therearound, the drum has a peripheral speed which is equal to that of the recording medium. However, this system involves a drawback that the recording member can be expanded or reduced during the image transfer operation, and/or the contact between the recording paper and the rotatable drum easily becomes insufficient. If one of those occurs, the registration is not satisfactory between different color images.

As for another type of color image formation, an assembly comprising a developing apparatus and a recording medium is provided for each of color components, and the assemblies are arranged in series. One recording sheet is sequentially contacted to the respective recording mediums so as to receive the different color component images in series. This type of system, however, results in that the overall apparatus is bulky. Additionally, the recording member can be fed obliquely, which leads to unsatisfacory registration of color images.

SUMMARY OF THE INVENTION

Accordingly, it is a principal object of the present invention to provide image recording method and apparatus wherein the problem of unsatisfactory registration arrising from plural image transfers to one recording sheet is solved by a novel and improved structure.

These and other objects, features and advantages of the present invention will become more apparent upon a consideration of the following description of the preferred embodiments of the present invention taken in conjunction with the accompanying drawings.

BRIEF DESCRIPTION OF THE DRAWING

The FIGURE is a sectional view of an image recording apparatus according to an embodiment of the present invention.

DETAILED DESCRIPTION OF THE PREFERRED EMBODIMENTS

Referring now to the FIGURE, there is shown an image recording apparatus according to an embodiment of the present invention. The image recording apparatus comprises a latent image bearing drum 1, a surface layer of a dielectric material having volume resistivity of not less than $10^{12}$ ohm.cm. The drum 1 is rotatable in the direction shown by an arrow by an unshown driving device. The image recording apparatus further comprises latent image forming means including a recording head 2 disposed closely to the latent image bearing drum 1 to apply electrostatic charge to the latent image bearing drum 1 in accordance with an image signal and comprises a developing device 3 which is a developer supplying means disposed downstream of the recording head 2 with respect to the direction of rotation of the latent image bearing drum 1.

To the recording head 2, an image processing circuit 27 is connected. When a signal voltage is applied from the image processing circuit 27 to the recording head 2 in accordance with the image to be recorded, while the latent image bearing drum 1 is rotated in the direction of the arrow by the unshown driving device, an electrostatic latent image is formed on the surface of the latent image bearing drum 1, corresponding to the pattern of the image to be recorded.

The latent image forming means having the recording head 2 will be described in further detail. The recording head 2 includes a first electrode 21, a first insulating layer 22, a second electrode 23, a second insulating layer 24 and a third electrode 25. The second electrode 23, the second insulating layer 24 and the third electrode 25 are provided with a number of through fine openings (having a diameter of approximately 100 microns) which are arranged coaxially with the latent image bearing drum 1. An alternating voltage source 26 applies an alternating voltage to the first electrode 21, while the image processing circuit 27 applies to the second electrode 23 either an on-voltage (an ion applying voltage) or an off-voltage (non-ion-applying voltage). Further, a DC source 28 is effective to apply a DC voltage to the third electrode 25. Due to these voltages being applied to the various parts, a potential difference is established between the on-voltage or off-voltage and the DC voltage, which potential difference is effective to either discharge the ions produced in the fine openings or prevent them from discharging.

The recording head 2 has been described as having a plurality of fine openings arranged coaxially with the latent image bearing drum, however, it is a possible alternative that a plurality of first electrodes and a plurality of the second electrodes are used so as to form a matrix thereby, and the fine openings are formed correspondingly to the crosspoints of the matrix. By doing so, the image can be recorded with higher resolution.

Further detailed explanation of the structure of the recording head 2 and of the latent image forming principle thereby, is omitted, because they are detailed in U.S. Pat. No. 4,160,257 to Carrish issued on July 3, 1979.

The signals from the image processing circuit 27 may be, as usual, the signals which have already been produced for three different color separated images. However, in the case where a color image is read by a photoconductive element, such as a charge coupled device, it is possible that the light from the color image is separated by principal color filters, i.e., red, green and blue, into color-separated light images, which are sequentially received by the photoconductive element so that image signals are sequentially produced and are applied to the image processing circuit 27 as input signals thereto.

The developing device 3 includes developing means 3C for supplying cyan toner TC, developing means 3M for supplying magenta toner TM and developing means 3Y for supplying yellow toner TY, those toner materials being developers applied to the electrostatic latent image formed on the latent image bearing drum 1. Each of the developing means 3C, 3M and 3Y includes a toner container 31 for containing the toner and a developing roller 32 disposed in the toner container. The developing roller 32 is of a conventional type including a conductive sleeve 33 and a stationary magnet 34 within a sleeve 33. The stationary magnet 34 has eight magnetic poles spaced at regular intervals, for example. Each of the developing means 3C, 3M and 3Y is provided with a doctor blade 35 for regulating the quantity of toner particles to be applied onto the sleeve 33. The developing device 3 is shown as consisting of three developing means 3C, 3M and 3Y, however, an additional developing means 3BK for applying black toner TBK may be employed. The developing agent may be either one component developer or two component developer with suitable developing means.

While the latent image bearing drum 1 is rotating, the toner is applied to the electrostatic latent image formed on the latent image bearing drum 1 from such one of the developing means 3C, 3M and 3Y as corresponds to the color to be developed, so that the latent image is developed into a toner (visualized) image. During this development operation, the other two developing means are kept inoperative so as not to supply the toner to the recording medium. In the illustrated embodiment, the doctor blade 35 for regulating the quantity of the toner applied on the sleeve 33, is movable toward and away from the sleeve 33, wherein the doctor blade 35 can be contacted to the sleeve 33 by an unshown driving mechanism to prevent the toner supply to the sleeve 33. As an alternative, the two developing means which should be kept inoperative may be displaced away from the latent image bearing drum 1 by an unshown driving mechanism. The process of toner image formation will be described in detail hereinafter.

The image recording apparatus further comprises a toner image bearing drum 4 which is a means for carrying the visualized image and is rotatable in press-contact with the latent image bearing drum 1. The toner image bearing drum 4 includes a hollow or solid rotatable member 41 of aluminum, steel or the like and a resilient member 42 of DELRIN resin (DuPont) fixedly secured to the outer surface of the rotatable member. As shown in the drawing, the toner image bearing drum 4 is rotated in the direction of an arrow by an unshown driving mechanism, while being in contact with the latent image bearing drum 1. During this rotation, the toner image which has been formed on the latent image bearing drum 1 is transferred onto the toner image bearing drum 4. The transfer of the toner image will be described hereinafter. For the purpose of improving the transfer of the toner image, the surface of the toner image bearing drum 4 is rougher than that of the latent image bearing drum 1. For example, the surface roughness of the latent image bearing drum is not more than approximately 0.6 microns RMS, preferably not more than approximately 0.1 microns RMS, while the surface roughness of the toner image bearing drum 4 is not more than approximately 3–4 microns RMS and not less than approximately 0.5 microns RMS.

After the toner image is transferred from the latent image bearing drum 1 to the toner image bearing drum 4, the latent image bearing drum 1 is rotated further in the direction of the arrow, and the cleaning device 5 removes the residual toner remaining thereon, and further, a discharging device 6 removes the residual electric charge remained on the latent image bearing drum 4.

As for the toner image bearing drum 4, there is provided a cleaning device 43 for removing the residual toner remained thereon. As will be described hereinafter, the cleaning device 43 is kept from contacting the toner image bearing drum 4 when the toner image bearing drum 4 carries a valid toner image which is the toner image to be transferred to a recording member, which will be described. It is kept contacted to the toner image bearing drum 4 otherwise. The cleaning device 43 is driven about a shaft **43*a*** in the direction of the arrow by an unshown driving mechanism.

Recording materials such as sheets of paper 7 are contained in an unshown cassette, and they are fed out one by one by a pick-up roller. The recording material picked out of the cassette is conveyed by conveying rollers 44 to a nip (image transfer portion A) formed between the latent image bearing drum 1 and the toner image bearing drum 4. Guides 45 are provided for the purpose of guiding the recording material 7 to the nip. Separation pawls 46 are provided in order to make sure that the recording material 7 is separated from the latent image bearing drum 1 and from the toner image bearing drum 4. Guiding members 47 serve to guide the recording material 7 separated by the separating pawls.

In operation, the light obtained through a red filter from an original is read by a photoconductive element such as a charge coupled device, and the resulting image signal is applied to the image processing circuit 27. By applying the outputs of the image processing circuit 27 to the recording head 2 while rotating the latent image bearing drum 1 in the direction of the arrow, an electrostatic latent image corresponding to the color component selected by the red filter is formed on the latent image bearing drum 1.

When the thus formed electrostatic latent image passes by the developing device 3 during the rotation of the latent image bearing drum 1, the cyan toner TC is supplied from the developing device 3C and is deposited to the latent image on the latent image bearing drum 1, thus visualizing the latent image into a cyan toner image. As described hereinbefore, the developing means 3M and 3Y are maintained inoperative so as not to supply the toner to the latent image bearing drum 1.

Since the latent image bearing drum 1 and the toner image bearing drum 4 are press-contacted at the transfer portion A, the visualized cyan toner image is pressed by the pressure therebetween, the cyan toner image is deposited onto the toner image bearing drum 4.

Then, the toner remained on the latent image bearing drum 1 after the toner image transfer, is scraped off the latent image bearing drum 1 by the cleaning device 5, and the electric charge remaining on the latent image bearing drum is removed by the charge removing device 6.

Those steps described above from the electrostatic latent image formation to the toner image transfer to the toner image bearing drum 4, are repeated but with respect to the other color signals, i.e., green filter signals and blue filter signals, wherein the images are developed with the magenta toner and the yellow toner, respectively. Those toner images are also pressure-transferred onto the same toner image bearing drum 4. Since the diameter of the toner image bearing drum 4 is constant and also since it rotates at a constant speed, it is easy to select a certain circumferential position of the drum as a reference leading position so that correct registration among the toner images on the toner image bearing drum 4 in the circumferential direction thereof can be easily achieved. As regards the registration in the direction of the drum axis, it can be easily achieved by employing the same length of the latent image bearing drum 1 and the toner image bearing drum 4 and confining them together at the opposite ends thereof. In the manner described above, a final toner image (color image) is provided on the toner image bearing drum 4, which image consists of a plurality of toner images (cyan toner image, magenta toner image and yellow toner image) which are in correct registration.

Thereafter, the latent image bearing drum or a dielectric drum 1 and the toner image bearing drum 4 are rotated further, and a recording material 7 is fed to and passed through the nip (transfer portion A) formed between the latent image bearing drum 1 and the toner image bearing drum 4 by the sheet conveying mechanism in timed relation with the above-described reference leading position of the toner image bearing drum 4 which is about passing through the transfer portion A. By doing so, the final toner image on the toner image bearing drum 4 is transferred onto the recording material 7 all at once. In this embodiment, the image transfer from the toner image bearing drum 4 to the recording material 7 is effected by the contact pressure between the latent image bearing drum 1 and the toner image bearing drum 4, which pressure results in the toner being deposited on the recording material 7. The color image now provided on the recording material 7 is already a practical image, as it is. If, however, a better color image is desired with the toner particles of different colors being further mixed, it is desirable to use a heater 48 to heat and fuse the toner on the final recording material 7.

As described hereinbefore, after the final toner image is transferred to the recording material 7, the toner remained on the toner image bearing drum 4 is scraped off by the cleaning device 43.

Description will be made with respect to the detailed examples of the apparatus according to the present invention. As for the latent image bearing drum 1, a Duralumin cylinder having the diameter of 100 mm was used as a base drum, which was coated with a material having the thickness of approximately 20 microns which was obtained by dispersing Teflon (DuPont) and alumina oxide or the like in light-setting resin and setting it by ultraviolet rays. The surface were abraded, thus providing the dielectric layer. It is a possible alternative that the surface of the base drum is subjected to anodic oxidation and is coated with polymethylacrylate dissolved in benzene, and then is abraded.

As regards the recording head 2, the alternating voltage applied to the first electrode 21 had the frequency of 800 kHz and the peak-to-peak voltage (Vpp) of 1900 V. To the second electrode 23, the on-voltage of 700 V and the off-voltage of 350 V were selectively applied. To the third electrode 25, the DC voltage of 650 V was applied from the DC power source 28. The insulating layers 22 and 24 were of ceramic material having the thickness of approximately 100 microns, respectively. The distance between the third electrode 25 and the latent image bearing drum 1 was approximately 0.2 mm.

As regards the developing device 3, the conductive sleeve 33 of each of the developing means 3C, 3M and 3Y was made of non-magnetic stainless steel formed into a hollow cylinder having the diameter of approximately 32 mm. The stationary magnet 33 in the sleeve 33 had eight magnetic poles spaced at regular intervals, and it provided magnetic flux density of approximately 340 Gauss on the surface of the sleeve 33. As for the toner, the toner particles mainly comprising polyester or polyethylene resin and coloring agents corresponding to the respective colors were used.

Regarding the toner image bearing drum 4, the rotatable member 41 was an aluminum member having a diameter of approximately 86 mm coated by a resilient member 42 of DELRIN available from DuPont, Japan. The diameter of the drum 4 having the rotatable member 41 with the resilient member 42 was approximately 100 mm. A resin blade was employed for the cleaning device 43 for cleaning the toner image bearing drum 4. If the close-contactability between the toner and the recording material 7 is high enough, and if the releasability between the toner and the toner image bearing drum 4 is high enough, the cleaning device 43 may be omitted.

As for the cleaning device 5 for the latent image bearing drum 1, a rubber blade was used. However, a metal blade or paper web or the like are usable.

A conventional type AC corona discharger was used for the discharging device 6, but the other type is usable.

With the structures detailed above, the latent image bearing drum 1 was rotated in the direction of the arrow at the peripheral speed of 120 mm/sec. When an image signal was applied to the recording head 2 from the image processing circuit 27 in accordance with a color component selected, an electrostatic latent image was formed on the latent image bearing drum 1, corresponding to the image pattern to be recorded. To the electrostatic latent image thus formed, the proper toner was supplied from the corresponding developing means of the developing device 3 to develop it into a visualized image.

The toner image visualized on the latent image bearing drum 1, was pressed by the press-contact between the latent image bearing drum 1 and the toner image bearing drum 4 so that the toner image was transferred onto and deposited on the toner image bearing drum 4. The contact pressure is 1–100 kg/cm. In this example, it was 20 kg/cm. Here, the pressure is expressed as a line pressure which is the force applied between the latent image bearing drum 1 and the toner image bearing drum 4 per unit length.

Then, the residual toner was scraped off the latent image bearing drum 1 by the cleaning device 5, and then the surface of the latent image bearing drum 1 was uniformly discharged by the discharging means 6.

The above-described process steps were repeated with respect to the other two colors so that the toner images formed with cyan toner TC, magenta toner TM and yellow toner TY were formed on the toner image bearing drum 4 in registration with one another. Next, a sheet of plain paper as the recording material 7 was supplied into the nip between the latent image bearing drum 1 and the toner image bearing drum 4, whereby the final toner image on the toner image bearing drum 4 was transferred onto the recording material 7 all at once. Subsequently, the transferred toner image was heated by a heater 48 so that the toner was fused and mixed, with the result that a very clear and correctly registered color image was provided.

The foregoing description of the embodiment and the detailed example has been made in the case where three kinds of toner are used, i.e., cyan toner, magenta toner and yellow toner so as to provide a full-color image recording. It is possible that black toner is further used. Additionally, the kinds of the toner are not limited to those. For example, the present invention is applicable to the case where only two kinds of toner, red toner and black toner are used to provide two color image recording. As for the recording head, another type may be used. For example, tips of a number of fine wires opposed to the surface of the latent image bearing drum 1 and arranged in an arrays co-axially with the drum 1 (as in the case of a stylus electrodes), which are supplied with image pattern signals from an image processing circuit so as to form an electrostatic latent image on the latent image bearing drum. Such or another electrostatic recording system may be used.

Further, the present invention is applicable to an image recording apparatus using an electrophotographic process with a rigid photoconductive member such as amorphous silicon or the like, as the latent image bearing drum. In this case, for example, the rigid photoconductive member is uniformly charged electrically, and thereafter, an electrostatic latent image is formed and is developed into a toner image, which is then transferred to a toner image bearing drum; and those steps are repeated for each of the color components, thus forming thereon one registered final image to be recorded which consists of a plurality of toner images. Then, the combined toner image is transferred onto a recording material all at once by pressure image transfer.

As described above, according to the present invention, it is made possible that a color image is formed on the recording material with a single image transfer operation to the recording material without the necessity of plural image transfers to the recording material. Therefore, the erroneous registration among the color component images which has been a problem with the conventional method and apparatus can be avoided. Additionally, the mechanism for feeding the same recording material to the transfer position a plurality of times, which has been required by the conventional method and apparatus, is not necessary so that the structure of the image recording apparatus is simplified with the remarkable stability of the image processing.

While the invention has been described with reference to the structures disclosed herein, it is not confined to the details set forth and this application is intended to cover such modifications or changes as may come within the purposes of the improvements or the scope of the following claims.

What is claimed is:

1. An image recording method, comprising:

a first step of forming an electrostatic latent image on a rotatable latent image bearing member;

a second step of supplying a developer to the electrostatic latent image to form a visualized image on the latent image bearing member;

a third step of transferring by pressure the visualized image from the latent image bearing member to a rotatable visualized image bearing member press-contacted to the latent image bearing member, through a nip formed between the latent image bearing member and the visualized image bearing member, the visualized image bearing member having a surface roughness larger than that of the latent image bearing member;

a fourth step ef repeating said first, second and third steps to form on the visualized image bearing member a multi-color image which consists of plural visualized images and which corresponds to one final image to be recorded, wherein when said second step is repeated, a visualized image is formed with a developer of a color which is different from a color with which the first mentioned second step is performed; and a fifth step of transferring by pressure all at once the multi-color image to a recording material by passing the recording material through the nip formed between the latent image bearing member and the visualized image bearing member bearing the multi-color image.

2. A method according to claim 1, wherein said electrostatic latent image is formed by applying ions from a recording head to the latent image bearing member in accordance with an image signal corresponding to an image of a color component to be recorded.

3. A method according to claim 1, wherein a surface of the visualized image bearing member is cleaned by cleaning means after the multi-color image on the visualized image bearing member is transferred by pressure all at once to the recording member.

4. A method according to claim 1, further comprising a step of heating the visualized image on the recording material to fuse and mix the developers, after the multi-color image is transferred from the visualized image bearing member to the recording material.

5. An image recording apparatus, comprising:

a rotatable latent image bearing member;

latent image forming means for forming an electrostatic latent image on said latent image bearing member;

developer supplying means for supplying to said latent image bearing member developers of different colors sequentially to form visualized images in different colors;

a rotatable visualized image bearing member press-contacted to said latent image bearing member, said visualized image bearing member receiving said visualized images sequentially from said latent image bearing member by pressure image transfer, through a nip formed between said latent image bearing member and said visualized image bearing member, to form on said visualized image bearing member a multi-color image of different colors and which corresponds to one final image to be recorded, said visualized image bearing member having a surface roughness larger than that of said latent image bearing member; and recording material conveying means for conveying a recording material to said nip formed between said latent image bearing member and said visualized image bearing member bearing the multi-color image, wherein the multi-color image is transferred by pressure all at once to the recording material when the recording material passes through said nip.

6. An image recording apparatus according to claim 5, wherein said latent image forming means forms the electrostatic latent image by applying ions to said latent image bearing member in accordance with an image signal corresponding to an image of a color component to be recorded.

7. An image recording apparatus according to claim 5, wherein said developer supplying means includes a plurality of developing means which respectively contain developers of different colors.

8. An image recording apparatus according to claim 5, further comprising cleaning means, displaceable toward and away from said visualized image bearing member, for cleaning said visualized image bearing member, said cleaning means being away from said visualized image bearing member when it carries the visualized image to be transferred, but being contacted to said visualized image bearing member otherwise.

9. An image recording apparatus according to claim 5, further comprising heating means for heating the visualized image on the recording material to fuse and mix the developers, after the multi-color image is transferred by pressure from said visualized image bearing member to the recording material.

* * * * *

UNITED STATES PATENT AND TRADEMARK OFFICE

CERTIFICATE OF CORRECTION

PATENT NO. : 4,682,880

DATED : July 28, 1987

INVENTOR(S) : HARUO FUJII, ET AL.

It is certified that error appears in the above-identified patent and that said Letters Patent is hereby corrected as shown below:

COLUMN 1

Line 31, "pluralty" should read --plurality--.
Line 54, "unsatisfacory" should read --unsatisfactory--.
Line 61, "arrising" should read --arising--.

COLUMN 4

Line 15, "remained" should read --remaining--.
Line 19, "remained" should read --remaining--.

COLUMN 5

Line 52, "remained" should read --remaining--.
Line 62, "were" should read --was--.

COLUMN 6

Line 14, "magnet 33" should read --magnet 34--.

UNITED STATES PATENT AND TRADEMARK OFFICE

CERTIFICATE OF CORRECTION

PATENT NO. : 4,682,880

DATED : July 28, 1987

INVENTOR(S) : HARUO FUJII, ET AL.

It is certified that error appears in the above-identified patent and that said Letters Patent is hereby corrected as shown below:

COLUMN 8

Line 13, "ef" should read --of--.

Signed and Sealed this

Tenth Day of May, 1988

*Attest:*

*Attesting Officer*

DONALD J. QUIGG

*Commissioner of Patents and Trademarks*